US005950882A

United States Patent [19]

Scott

[11] Patent Number: 5,950,882

[45] Date of Patent: Sep. 14, 1999

[54] HANGING GARMENT DRYER

[76] Inventor: Joe B. Scott, 3604 38th St., Lubbock, Tex. 79413

[21] Appl. No.: 08/652,956

[22] Filed: May 24, 1996

Related U.S. Application Data

[63] Continuation of application No. 08/297,624, Aug. 29, 1994, abandoned.

[51] Int. Cl.[6] ..... A47G 25/28

[52] U.S. Cl. ..... 223/85; 223/92; 223/DIG. 4

[58] Field of Search ..... 223/85, 88, 92, 223/95, DIG. 2, DIG. 4; 211/105.1, 123, 193; 248/304, 205.1; 206/477, 480, 483

[56] References Cited

U.S. PATENT DOCUMENTS

| | | | |
|---|---|---|---|
| 666,235 | 1/1901 | Osgood . | |
| 920,894 | 4/1909 | Bousall | 223/194 |
| 994,419 | 6/1911 | Metzger | 223/194 |
| 1,049,867 | 1/1913 | Kalina . | |
| 1,114,002 | 10/1914 | Kalina | 223/94 |
| 1,245,425 | 11/1917 | Becker | 223/94 |
| 2,576,303 | 11/1951 | Matter | 312/206 |
| 3,254,814 | 6/1966 | Weir et al. | 223/89 |
| 3,822,783 | 7/1974 | Mortensen | 206/223 |
| 4,004,721 | 1/1977 | Ross | 223/89 |
| 4,592,497 | 6/1986 | Georges | 223/69 |
| 4,673,114 | 6/1987 | Douglas | 223/89 |
| 4,819,812 | 4/1989 | Demarest, Jr. | 211/1.3 |
| 5,074,446 | 12/1991 | Suddath | 223/92 |
| 5,104,083 | 4/1992 | Shannon | 248/339 |

FOREIGN PATENT DOCUMENTS

| | | | |
|---|---|---|---|
| 3302590 | 8/1984 | Germany | 223/85 |
| 2117232 | 10/1983 | United Kingdom | 211/193 |

*Primary Examiner*—Bibhu Mohanty
*Attorney, Agent, or Firm*—Cahill, Sutton & Thomas, P.L.C.

[57] ABSTRACT

A hanger for drying clothes thereupon constructed from plastic or other rust resistant material. The hanger is constructed to be hung from a stationary object or member which will commonly be a door or wall. The hanger includes an extension arm which is connectable at one end nearest the door or wall to a suspender. Oppositely and on a distal end, a collapsible hanger is installed. The hanger has a connector that is installable upon the extension arm and the hanger also has hanger arms which are jointed and extendable within a piece of clothing. In use, the hanger will be emplaced within a wet garment to be dried and additional jointed members will be installed at distal ends of the hanger arms so as to fully support and expand the hanging wet article for drying. In this manner, wrinkle-free and expedited drying of durable, as well as fragile wearing apparel may be accomplished while the original shape of the garment is maintained.

22 Claims, 3 Drawing Sheets

FIG. 1
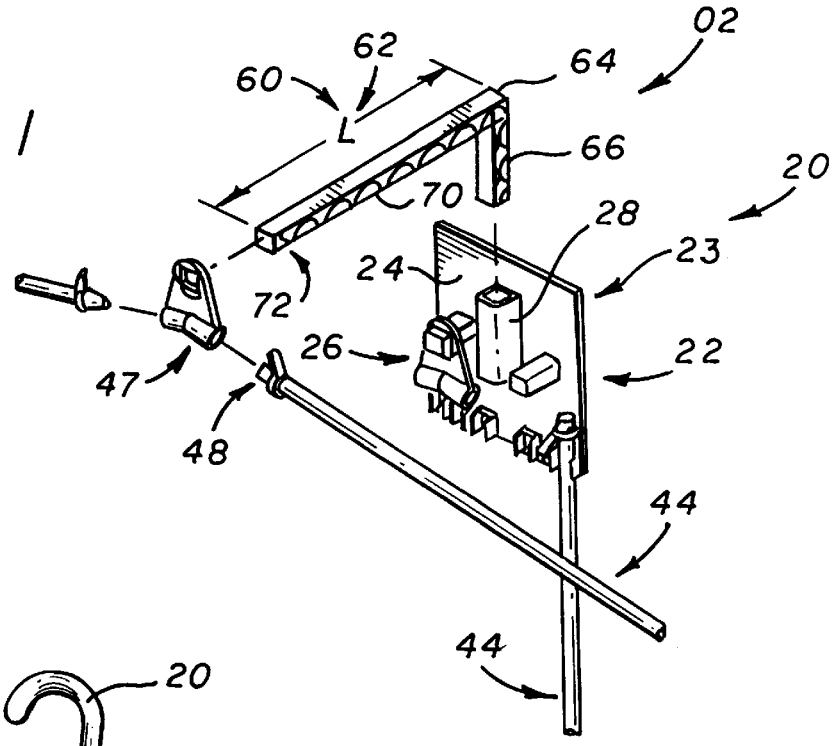
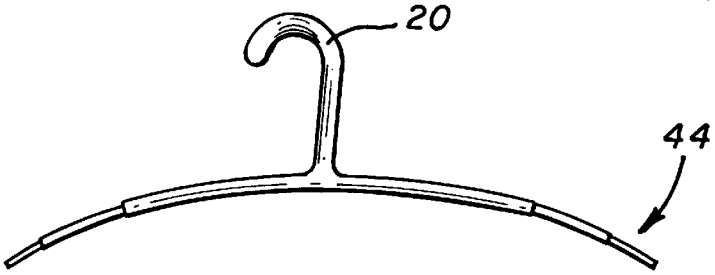
FIG. 9
FIG. 2
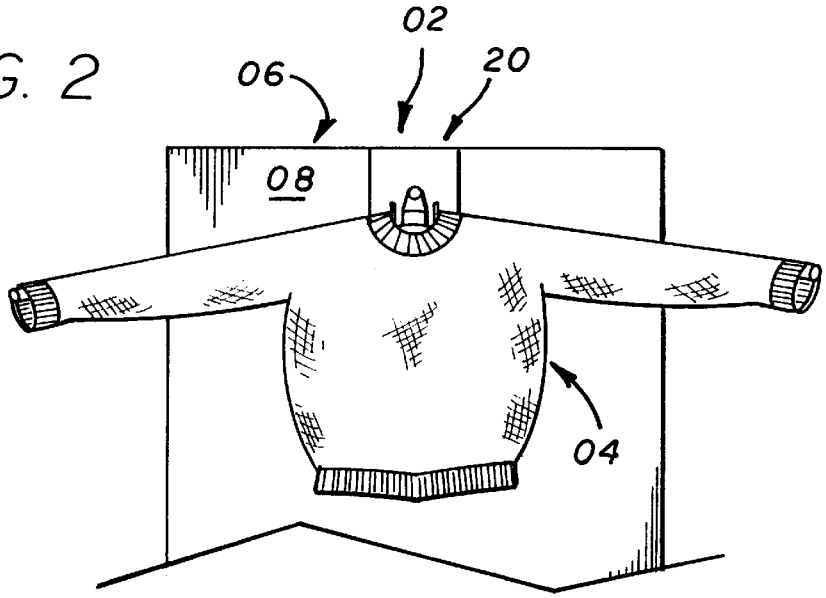

FIG. 3
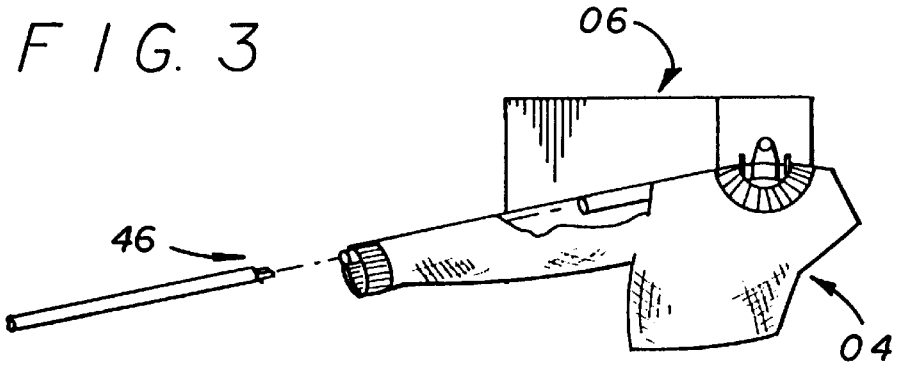
FIG. 4a
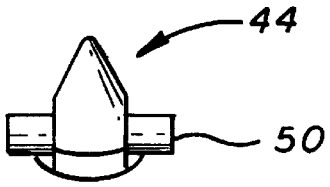
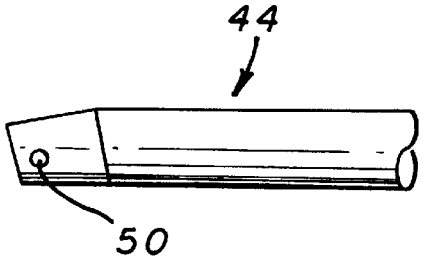
FIG. 4b
FIG. 5
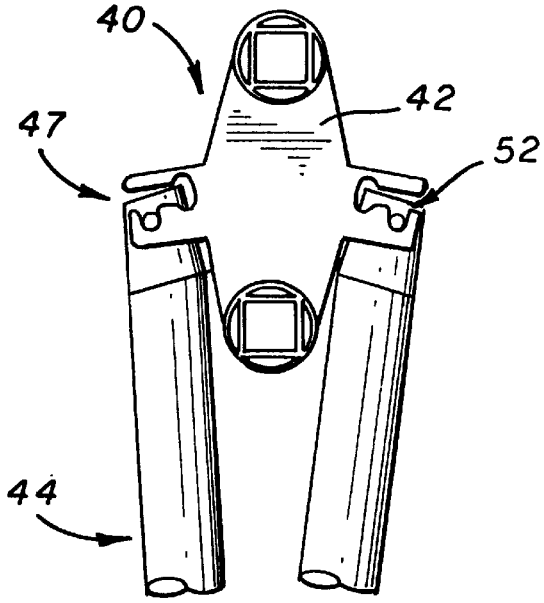

HANGING GARMENT DRYER

This a continuation of pending prior application Ser. No. 08/297,624, filled Aug. 29, 1994, now abandoned, for "HANGING GARMENT DRYER."

FIELD OF THE INVENTION

This invention relates to garment hangers, and more particularly to garment hangers that are used to hang dry wet pieces of clothing.

BACKGROUND OF THE INVENTION

Clothes type hangers of varying designs have been known in the art for many years. The clothes hanger is used to maintain a piece of clothing in a shape similar to that as when it is being worn. Hangers are also used to store and preserve articles of clothing in a wrinkle free form. Many commonly known hangers may be used to hang a pair of pants while simultaneously hanging a coat or other garment worn upon the upper body of a person. Because a garment is typically finished, that is laundered and pressed, before being placed upon a hanger, it is not necessary that the hanging article be fully extended upon the hanger. Instead, it will be allowed to drape over the hanger with certain portions of the clothing piece folded upon itself. Many types of clothing, particularly more expensive clothing, may require hand washing and air drying.

The benefits of air drying an article of clothing flat on a surface are well known, but it is equally well known that this drying process may not be thorough and may require extended periods of time for completion. During these extended time periods, the clothing may sourer or mold because of inadequate circulation and air to garment contact. Furthermore, large surface areas may be monopolized throughout the drying time. If a conventional clothes hanger is used within a wet article, however, particularly those having great weight and susceptibility when wet to stretch, the article may be damaged or ruined during drying. Examples of such garments would be wool sweaters and cotton sweat shirts. Often, this type of drying will cause irreparable sags and stretches that occur during the hang drying process due to inconsistent support of the clothing article and the weight of the water initially contained therein. Still further, conventional clothes hangers do not provide support for the neck of the garment to assure maintenance of the garment's original shape during the hang dry process.

Even with the technological advances in laundry care machinery, many fine garments still require hand washing and/or air drying. Therefore, a need for more expedient and wrinkle free hang drying has been realized that will maintain an article of clothing in its original form.

SUMMARY OF THE INVENTION

The invention disclosed herein provides a garment hanger constructed from plastic or other suitable non-corrosive material that will not rust or otherwise degrade when used within wet clothing. It is adaptable to be hung on various stationary members and may be most conveniently hung upon doors found in most, if not all modern dwellings. The invention includes a suspension means that is directly connectable to the stationary member and an extension means to which a hanging means is attached. The purpose of the extension means is to provide spacing between the garment to be dried and the stationary member that may restrict air flow about the wet piece of clothing. It is contemplated that the extension arm may be of varying length depending upon the degree of air flow required about the wet garment and the size and number of garments to be placed upon the extension arm for drying. It is contemplated that multiple hangers may be connected to the extension arm so that several pieces of clothing may be simultaneously dried. Should several articles be dried at once, it is necessary that the extension arm have sufficient length to allow air flow between the several pieces of clothing.

The hanger is adaptable so that an article of clothing being dried thereupon may be fully extended into a configuration similar to that achieved by drying the article flat. When installing the hanger within a sweater, for instance, additional jointed members may be subsequently installed upon the hanger arms to achieve a fully unfurled, unwrinkled and expanded configuration. Alternatively, the hanger arms may be telescoped so that extension may be accomplished by simply extending retracted segments of the arms. In this way, quick, thorough drying and wrinkle free results are obtainable with the hanging garment dryer.

It is contemplated that a garment hanger as defined herein for suspending a garment in a fully extended and expanded orientation for wrinkle free drying would include a suspension means mountable to a stationary member such as a door or wall. There is an extension means releasably connected to the suspension means. The extension means has a suitable extension length for positioning the garment away from the stationary member at a distance sufficient to allow air flow between the garment and the stationary member thereby promoting even drying. A hanging means is releasably connected to the extension means and is jointedly constructed for insertion into the garment so that the garment is hung in a fully extended orientation from the garment hanger.

The suspension means includes a plurality of receivers mounted upon a front surface of the suspension means for suspending components of the hanging means when the garment hanger is not in use.

The suspension means further includes an extension arm receptacle mounted upon a front surface of the suspension means for receiving an extension arm of the extension means when the garment hanger is in use.

The suspension means additionally includes a connection means for temporarily fixing the garment hanger upon the stationary member and a substantially flat back surface for face-to-face abutment with a vertical surface of the stationary member for maintaining proper orientation therewith during use.

The suspension means is connected upon the stationary member at a sufficient elevation above ground to prevent a hanging piece of clothing from dragging the ground when suspended from the garment hanger.

The extension means includes a substantially L-shaped extension arm. The extension arm has two legs, a substantially vertical leg that is insertable into an extension arm receptacle mounted upon the suspension means and a substantially horizontal leg that is connected to, and extends from, the vertical leg away from the suspension means and terminates in a distal end of the horizontal leg.

The hanging means additionally includes a hanger connector constructed for releasable connection to a distal end of the extension means and hanger arms, for insertion into the garment to be dried on the garment hanger, releasably connected to the hanger connector.

The hanger arms are releasably connected to the hanger connector by a locking means. The locking means is capable of dangling the hanger arms from the connector when the hanger is not in use and locking the hanger arms in substantially horizontal positions when it is in use.

The hanger arms have jointed members making it possible to achieve variable extension lengths of the arms.

The hanger arms further comprise collar positioning tabs located proximate to the hanger connector.

The garment hanger may be constructed predominantly from plastic or other rust resistant materials, such as stainless steel, that will not react with wet clothing placed thereupon.

In an alternative embodiment of the disclosed invention, it is contemplated that a garment hanger of the nature illustrated in FIG. 9 may be provided. Therein, a garment hanger is provided for suspending a garment in a fully extended orientation for wrinkle free drying. The garment hanger has a suspension means for suspending the garment hanger from a stationary member such as a clothes rod or shower curtain rod. The hanger has a hanging means with extendable arms that may be inserted into a wet garment without unduly stretching the garment. When the arms are extended, the garment is hung in a fully unfurled and extended orientation from the garment hanger for wrinkle free drying.

In one embodiment, the extendable arms are telescoping for easy insertion into a wet garment when in a retracted configuration and then extendable after insertion for achieving the fully extended orientation of the hanging wet garment to be dried.

This invention also provides a method for hang drying a wet piece of clothing wrinkle free. The steps for this drying process include inserting an extendable hanging means into the wet piece of clothing while the hanging means is in an unextended configuration and then extending the hanging means so that the piece of clothing is fully extended. The hanging means is then suspended from a support member where the wet piece of clothing will be allowed to hang dry. It is contemplated that elongation of the hanging means may include extending telescoping arms that are initially retracted for insertion into the piece of clothing.

For added versatility, the method for hang drying the wet piece of clothing may include positioning multiple pieces of clothing upon the support member for simultaneous drying and spacing the multiple pieces of clothing upon the support member so that air circulation is provided between individual pieces to facilitate hang drying.

BRIEF DESCRIPTION OF THE DRAWINGS

FIG. 1 is an exploded perspective view of the garment hanger.

FIG. 2 is a front view of the garment hanger, in use, with a wet garment drying thereon in a fully extended orientation.

FIG. 3 is a broken view with a partial cut-away of a wet garment drying upon a garment hanger showing the jointed members of a hanger arm in an exploded orientation.

FIG. 4*a* is an end view of a hanger arm.

FIG. 4*b* is a side view of a connectable end of a hanger arm.

FIG. 5 is a front view of hanger arms dangling from a hanger connector.

FIG. 9 is a front view of an extendable hanger.

DESCRIPTION OF THE PREFERRED EMBODIMENT

Figure 6:
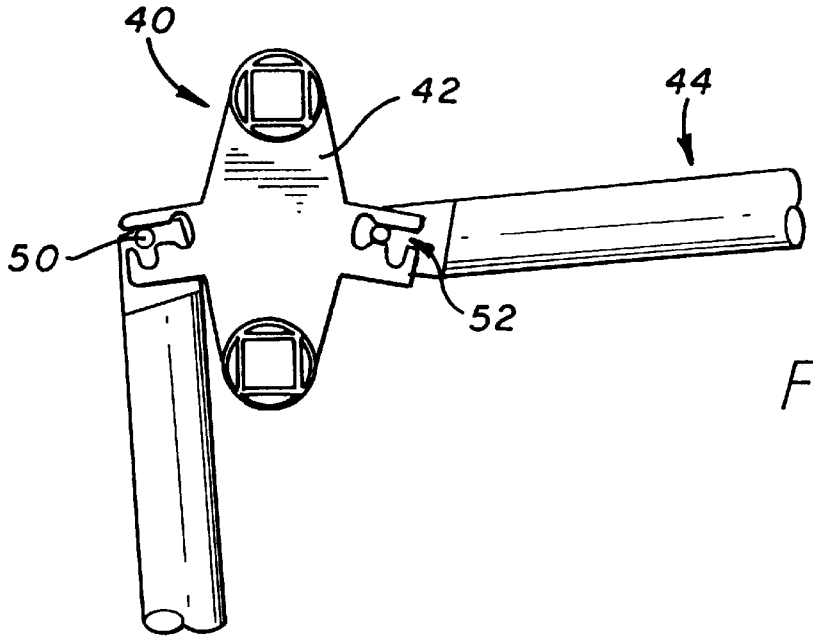
FIG. 6 is a front view of two arms installed upon a hanger connector with the left arm raised upwardly for insertion into the locking means and the right arm raised and inserted into the locking means, but not yet in a locked position.

Referring to FIG. 1, a garment hanger 02 is shown with its several components assembled in an exploded configuration. FIG. 2 shows the garment hanger 02 mounted upon a door and with a garment 04 hanging therefrom. In the embodiment shown therein, the door serves as stationary member 06 that has a height sufficient to prevent the garment 04 from contacting or dragging the ground.

The garment hanger 02 includes a suspension means 20 that is mountable directly to a stationary member 06; examples of such stationary members 06 would be doors and walls. It should be understood, however, that any object presenting a substantially vertical surface 08 suitable for mounting of the suspension means 20 would satisfy the requirements of the invention claimed herein. Referring once again to FIG. 1, a connection means 22 is shown with a front surface 24 facing outwardly and a back surface 23 there behind. Receivers 26 are mounted upon the front surface 24 of the connection means 22. The receivers 26 serve as receptacles for various components of the garment hanger 02 during times of storage. In the example of FIG. 1, a hanger arm 44 is shown hanging in the right most receiver 26. An extension arm receptacle 28 is likewise shown mounted upon front surface 24. Because of the nature of the illustrated embodiment, the extension arm receptacle 28 is oriented so that a longitudinal center line of that receptacle 28 is substantially vertical.

A hanging means 40 is connected to the suspension means 20 by extension means 60. The extension means 60 is constructed from plastic in the illustrated embodiment and is substantially L-shaped. The L-shaped extension means 60 comprises a substantially vertical leg 66 and a substantially horizontal leg 70. Extension arm 64 comprises the horizontal leg 70 and has an extension length 62 (L) substantially corresponding to a length of the horizontal leg 70. In the embodiment shown in FIG. 1, it is contemplated that the vertical leg 66 will be inserted into the extension arm receptacle 28 thereby fixing the extension means 60 location therewith. The extension arm 64 extends away from the suspension means 22 toward a distal end 72 of the extension arm 64. When installed, the extension arm 64 is substantially oriented in a horizontal configuration.

The hanger means 40 is releasably connectable to the distal end 72 of the extension arm 64 at hanger connector 42. In the illustrated embodiment of FIG. 1, the hanger connector 42 is shown as having a receiver for the distal end 72 of the extension arm 64 and two tubular connections for receiving matable ends of the hanger arms 44. The interior of the connection tubes, as well as the exterior of the ends of the hanger arms 44, are constructed for matable engagement. When installed, the hanger arms 44 extend from the hanger connector at angles slightly below horizontal thereby substantially conforming with the natural incline of the shoulder and sleeve portions of garment 04 as shown in FIG. 2. Referring to FIG. 3, it may be seen that the hanger arms 44 are contemplated as having a plurality of jointed members connectable end-to-end, one to the other. Alternatively, it is contemplated that the arms may be telescoping. Collar positioning tabs 48 are also shown in FIG. 1 upon the hanger arms 44. In use, the collar tabs 48 rest against an interior edge of the garment's 04 collar so that the proper shape of the collar of the dried garment will be achieved through use of the invention.

Figure 7:
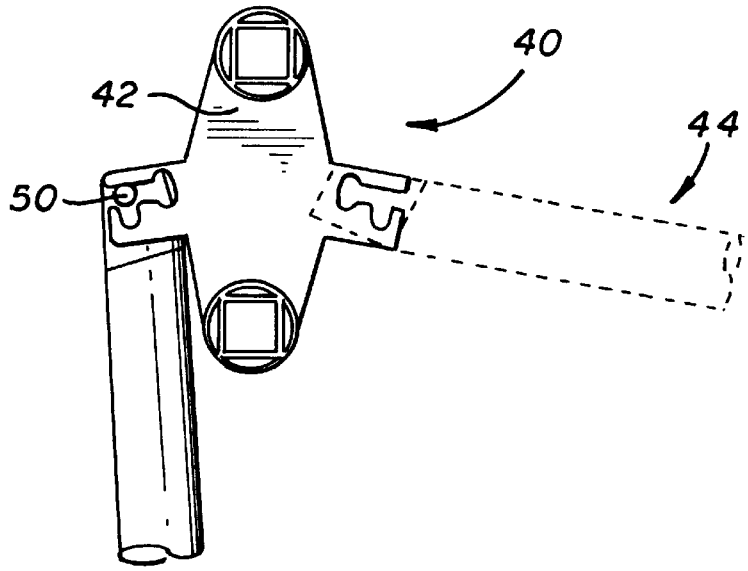
FIG. 7 is a front view of two arms installed upon a hanger connector with the left arm raised upwardly for insertion into the locking means and the right arm shown in phantom and in a locked position.
Figure 8:
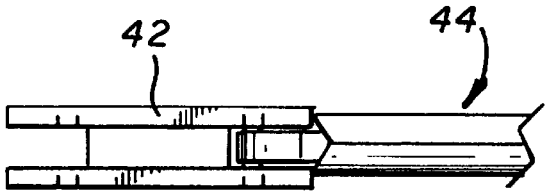
FIG. 8 is a top view of an arm raised and locked in an extended position.

An alternative embodiment of the hanging means 40 is illustrated in FIGS. 4 through 8. Therein, a locking means 47 is shown as being partially constructed into the hanger connector 42. Opposing lock pins 50 are connected upon an end of the hanging arms 44. The lock means 47 comprises the lock pins 50 together with lock channels 52 which are cut into the hanger connector 42 itself. As may be seen in FIG. 5, the hanger arms 44 may be installed upon the hanger connector 42 so that the arms 44 are allowed to freely dangle from the connector 42. This is accomplished by allowing the pin 50 to rest within lower recesses of the lock channel 52. Normally, the configuration of FIG. 5 will be utilized during transport and storage of the garment hanger 02. When use of the hanger 02 is desired, the arm 44 will be raised upwardly out of the recess of the locking means 47 as illustrated with the left hand arm of FIG. 6. The arm 44 will then be inserted along the lock channel 52 toward the center of the connector 42 until the pin 50 reaches the interior lock chamber of the locking means 47. When inserted therein, the arm 44 is allowed to drop into a braced and locked position as shown in FIG. 7, in phantom. As illustrated, the weight of the arm 44 maintains the pin 50 in an uppermost recess of the lock channels 52 with a lower edge of the arm in a butting contact with the hanger connector 42. FIG. 8 shows a top view of the hanger arm 44 locked into position upon the connector 42 and poised for receiving a garment 04 to be dried.

The hanger arm 44 is seen as having a pie-shaped cross-section in FIG. 4*a*. This configuration is also evident in other figures, with FIGS. 2 and 3 illustrating the pie-shaped arm 44 inserted into the wet hanging garment 04. The apex or point of the pie-shaped arm 44 is oriented upwardly so that a ridge or crease is formed at the top of a shirt's sleeves 04 hanging thereon. In this manner, a crease may be created along the top of the sleeves of a long sleeve shirt or pair of pants that is fully extended from cuff to cuff as is exemplified in FIGS. 2 and 3.

In use, it is contemplated that the hanging means 40 will be manually moved from the storage position of FIG. 5 to an erect position as illustrated by the right hand side of FIG. 7. In this erect position, the hanging means 40 resembles a clothes hanger which may then be inserted into a wet garment 04 for which wrinkle-free drying is desired. To fully extend the wet garment 04, an additional jointed member 46 may be inserted through the sleeve of the garment as illustrated in FIG. 3. Alternatively, a telescoped arm may be extended. Having achieved complete extension of the garment 04, the hanging means 40 may then be installed on the distal end 72 of the extension means 60. At this juncture, the extension arm 64 may have already been emplaced upon the suspension means 20 or it may then be inserted within the receptacle 28. After installation of the entire garment hanger 02 is made upon the stationary member 06, the garment is allowed to hang until complete drying is effected. Thereafter, the garment may be removed from the hanger 02 and worn in its wrinkle free condition.

An alternative embodiment is illustrated in FIG. 9 in which a garment hanger 02 is shown with a suspension means 20 connected to extendable hanger arms 44.

It will be appreciated by those of skill in this particular art that the foregoing detailed description is to be clearly understood as being given by way of illustration and example only of the subject invention. The spirit and scope of the present invention is limited solely by the appended claims.

What is claimed is:

1. A garment hanger suspended from a stationary member for vertically dependingly suspending a fully extended garment for wrinkle-free drying, said garment hanger comprising in combination:

(a) an extension arm extending from the stationary member;

(b) a hanger connector supported by said extension arm and including means for preventing rotation of said hanger connector in a vertical plane relative to said extension arm;

(c) a pair of hanger arms for penetrable insertion into the respective shoulder and sleeve portions of the garment to be suspended; and (d) attachment means for detachably attaching said pair of hanger arms to said hanger connector to retain and maintain said pair of hanger arms extending in opposed directions to suspend the garment.

2. A garment hanger suspended from a stationary member for vertically dependingly suspending a fully extended garment for wrinkle-free drying, said garment hanger comprising in combination:

(a) an extension arm extending from the stationary member;

(b) a hanger connector supported by said extension arm and including means for preventing rotation of said hanger connector in a vertical plane relative to said extension arm; and (c) a pair of hanger arms detachably attachable to said hanger connector to extend in opposed directions for penetrable insertion into the respective shoulder and sleeve portions of the garment to be suspended, each hanger arm of said pair of hanger arms including an upper cross-section defining a vertically upwardly oriented apex extending along the length of each hanger arm of said pair of hanger arms for forming a crease in the adjacent material of the garment drying upon said garment hanger.

3. The garment hanger as set forth in claim 1 including suspension means for detachably attaching said extension arm to the stationary member.

4. The garment hanger as set forth in claim 3 wherein said suspension means includes means for dependingly supporting each hanger arm of said pair of hanger arms to the stationary member after detachment from said hanger connector.

5. The garment hanger as set forth in claim 4 wherein said suspension means includes means for attaching said hanger connector to the stationary member.

6. The garment hanger as set forth in claim 1 including a jointed member for attachment to each hanger arm of said pair of hanger arms to extend the garment supporting length of said pair of hanger arms.

7. The garment hanger as set forth in claim 1 wherein the garment includes a collar and wherein said garment hanger includes a collar tab extending vertically upwardly and positionable upon each hanger arm of said pair of hanger arms to bear against and to position the collar of the garment relative to said hanger connector.

8. The garment hanger as set forth in claim 1 including locking means for securing each hanger arm of said pair of hanger arms with said hanger connector.

9. The garment hanger as set forth in claim 8 wherein said locking means comprises a pair of hollow receivers formed in said hanger connector and a stub disposed at one end of each hanger arm of said pair of hanger arms for penetrable engagement with the respective one of said pair of hollow receivers.

10. The garment hanger as set forth in claim 8 wherein said locking means comprises opposed pairs of slots formed in opposed sides of each one of said pair of hollow receivers and a pin extending in opposed directions at one end of each hanger arm of said pair of hanger arms for engaging the respective one of said pairs of slots.

11. The garment hanger as set forth in claim 10 including a channel disposed in said hanger connector intermediate the slots of each pair of said pairs of slots for supporting the respective one of said one end of said pair of hanger arms.

12. A garment hanger suspended from a stationary member for vertically dependingly suspending a garment for wrinkle-free drying, said garment hanger comprising in combination:

(a) an extension arm extending from the stationary member;

(b) a hanger connector supported by said extension arm and including means for preventing rotation of said hanger connector in a vertical plane relative to said extension arm;

(c) at least one hanger arm for penetrable insertion into the garment to be dried to support the garment while the garment is drying; and (d) attachment means for detachably attaching said at least one hanger arm to said hanger connector to retain and maintain said at least one hanger arm extending from said hanger connector in fixed relationship thereto.

13. A garment hanger suspended from a stationary member for vertically dependingly suspending a garment for wrinkle-free drying, said garment hanger comprising in combination:

(a) an extension arm extending from the stationary member;

(b) a hanger connector supported by said extension arm and including means for preventing rotation of said hanger connector in a vertical plane relative to said extension arm; and (c) at least one hanger arm detachably attachable to said hanger connector to extend laterally for penetrable insertion into the garment to be dried to support the garment while the garment is drying, said at least one hanger arm including upper cross-section defining a vertically upwardly oriented apex extending along the length of said at least one hanger arm for forming a crease in the adjacent material of the garment drying upon said garment hanger.

14. A method for vertically dependingly suspending a fully extended garment having shoulder and sleeve portions from a garment hanger, which garment hanger is secured to a stationary member by an extension arm supporting a hanger connector to dry the garment wrinkle-free, said method comprising the steps of:

(a) detachably attaching a pair of hanger arms to the hanger connector to extend in opposed directions;

(b) preventing rotation of the hanger connector in a vertical plane relative to the extension arm; and (c) penetrably inserting into the respective shoulder and sleeve portions of the garment to be suspended the pair of hanger arms to suspend the garment from the garment hanger.

15. The method as set forth in claim 14 including the steps of providing each hanger arm with an upper cross-section defining a vertically upwardly oriented apex extending along the length of each hanger arm and of forming a crease in the adjacent material of the garment during drying of the garment.

16. The method as set forth in claim 14 wherein the garment includes a collar and wherein the garment hanger includes a collar tab extending vertically upwardly and positionable upon each hanger arm and including the step of positioning the collar tabs adjacent and relative to the collar of the garment.

17. The method as set forth in claim 4 including the step or stretching downwardly each side of the garment to remove any wrinkles or folds in the garment prior to drying of the garment, said step of preventing resisting rotation of the garment in the vertical plane during exercise of said step of stretching.

18. A method for vertically dependingly suspending a wet garment to dry wrinkle-free from a garment hanger which garment hanger is suspended from a stationary member by an extension arm supporting a hanger connector, said method comprising the steps of:

(a) detachably attaching at least one hanger arm to the hanger connector;

(b) preventing rotation of the hanger connector in a vertical plane relative to the extension arm; and (c) penetrably inserting at least one hanger arm into the garment to be suspended.

19. The method as set forth in claim 18 including the steps of providing each hanger arm with an upper cross-section defining a vertically upwardly oriented apex extending along the length of each hanger arm and of forming a crease in the material of the garment adjacent the apex during drying of the garment.

20. The method as set forth in claim 18 including the step of stretching downwardly the garment supported by the at least one hanger arm to remove any wrinkles or folds in the garment prior to drying of the garment, said step of preventing resisting rotation of the garment in the vertical plane during exercise of said step of stretching.

21. A garment hanger suspended from a stationary member for vertically dependingly suspending a fully extended garment for wrinkle-free drying, said garment hanger comprising in combination:

(a) an extension arm extending from the stationary member;

(b) a pair of hanger arms detachably attachable to said hanger connector to extend in opposed directions for penetrable insertion into the respective shoulder and sleeve portions of the garment to be suspended; and (c) each hanger arm of said pair of hanger arms including an upper cross-section defining a vertically upwardly oriented apex extending along the length of each hanger arm of said pair of hanger arms for forming a crease in the adjacent material of the garment drying upon said garment hanger.

22. A method for vertically dependingly suspending a fully extended garment having shoulder and sleeve portions from a garment hanger, which garment hanger is secured to a stationary member by an extension arm supporting a hanger connector to dry the garment wrinkle-free, said method comprising the steps of:

(a) detachably attaching a pair of hanger arms to the hanger connector to extend in opposed directions;

(b) penetrably inserting into the respective shoulder and sleeve portions of the garment to be suspended the pair of hanger arms to suspend the garment from the garment hanger; and (c) providing each hanger arm with an upper cross-section defining a vertically upwardly oriented apex extending along the length of each hanger arm and forming a crease in the adjacent material of the garment during drying of the garment.

* * * * *